US005944502A

United States Patent [19]

Denchfield

[11] Patent Number: 5,944,502

[45] Date of Patent: Aug. 31, 1999

[54] WEAPON STIMULATOR

[75] Inventor: Clifford Denchfield, Huntingdon, United Kingdom

[73] Assignee: Lockheed Martin Tactical Systems U.K. Limited, Hertfordshire, United Kingdom

[21] Appl. No.: 09/029,192

[22] PCT Filed: Sep. 2, 1996

[86] PCT No.: PCT/GB96/02161

§ 371 Date: Apr. 27, 1998

§ 102(e) Date: Apr. 27, 1998

[87] PCT Pub. No.: WO97/09580

PCT Pub. Date: Mar. 13, 1997

[30] Foreign Application Priority Data

Sep. 2, 1995 [GB] United Kingdom ..... 9517919

[51] Int. Cl.[6] ..... F23C 11/04

[52] U.S. Cl. ..... 431/1; 446/401; 42/55

[58] Field of Search ..... 42/55; 446/401, 446/405; 431/1

[56] References Cited

U.S. PATENT DOCUMENTS

| | | | |
|---|---|---|---|
| 2,950,592 | 8/1960 | Frank | 431/1 |
| 3,091,224 | 5/1963 | Rydberg | 431/1 |
| 4,260,361 | 4/1981 | Huber | 431/1 |
| 5,090,891 | 2/1992 | Hemsath | 431/1 |
| 5,180,878 | 1/1993 | Denchfield | 42/55 |

*Primary Examiner*—Carroll B. Dority
*Attorney, Agent, or Firm*—Townsend and Townsend and Crew

[57] ABSTRACT

A weapon simulator comprising a combustion chamber (1), means (2) for admitting fuel gas to the combustion chamber, an inlet valve (9) for admitting air to the combustion chamber, the inlet valve being biased open at ambient pressure and arranged to close in response to both pressure rise and drop in the combustion chamber, means (7) to introduce ambient air into the combustion chamber through the valve (9), ignition means (3) for igniting fuel gas in the combustion chamber to cause an explosion, and an exhaust port (2) in the combustion chamber through which exhaust gases can exit rapidly and with audible results in response to explosive pressure rise within the combustion chamber.

10 Claims, 2 Drawing Sheets

WEAPON STIMULATOR

TECHNICAL FIELD

The invention relates to a weapon simulator for use for example in gunnery or weapons training to simulate the sound of gunfire or the explosion of, for example, a weapon strike.

BACKGROUND ART

It is known to provide gunfire simulators which simulate the flash and noise of a gun being fired. At their simplest such gunfire simulators may be no more than blank cartridges which directly take the place of live ammunition. However for use in simulating the firing of battlefield weapons from small arms, through missile launchers to heavy guns such as tank guns and field artillery it is known to provide pyrotechnic devices which are housed in a metal block which may, for example, hold 12, 20 or 24 rounds and which is fixed to the exterior of the weapon platform close to the barrel of the weapon in question. Usually the weight of such devices is such that they cannot be fixed directly to the barrel of the weapon. Often the devices are sufficiently bulky to create an obstruction to the sight of the tank or gun crew. Since such devices are limited to a relatively small number of rounds, a lack of realism can result. Also the cost of the pyrotechnic devices, while being much less than that of live ammunition, is nevertheless appreciable.

Our U.K. Patent GB 2250333 discloses a gunfire simulator comprising a combustion chamber, means for admitting fuel gas to the combustion chamber, a flap valve for admitting air to the combustion chamber, means to force ambient air into the combustion chamber through the flap valve, ignition means for igniting fuel gas in the combustion chamber to cause an explosion, an exhaust port in the combustion chamber and outlet valve means in the form of a frangible diaphragm for closing the exhaust port and arranged to open rapidly and with audible result in response to explosive pressure rise within the combustion chamber. In use the fuel gas in the combustion chamber will be ignited by the ignition means, which may comprise a spark plug, to cause an explosion of gases from the exhaust port resulting not only in noise but also a flash which further simulates gunfire.

It is a particular object of the invention to provide a weapon simulator which generates sound but does not require a frangible diaphragm.

DISCLOSURE OF INVENTION

According to the invention there is provided a weapon simulator comprising a combustion chamber, means for admitting fuel gas to the combustion chamber, an inlet valve through which air can be admitted to the combustion chamber, the inlet valve being biased open and arranged to close in response both to pressure rise above atmospheric and to pressure drop below atmospheric in the combustion chamber, means to induce ambient air into the combustion chamber through the inlet valve, ignition means for igniting fuel gas in the combustion chamber to cause an explosion, and an exhaust port in the combustion chamber through which exhaust gases can exit rapidly and with audible results in response to explosive pressure rise within the combustion chamber.

The function of the inlet valve is to close rapidly on pressure rise in the combustion chamber due to explosive combustion of the fuel gas and to close rapidly in response to the creation of a depression in the combustion chamber due to the subsequent rapid evacuation of the combustion gases through the exhaust port. It has been found that the rapid shutting of the inlet port at the onset of the depression in the combustion chamber increases the sound level created by the simulator.

The fuel gas admission means is preferably a device which precisely meters the amount of fuel admitted. The fuel gas admission means may be a solenoid valve. The means for admitting fuel gas into the combustion chamber is preferably arranged to direct the fuel in a direction towards the inlet valve.

The inlet valve may comprise a resiliently suspended member arranged for movement in opposite directions and arranged to close an opposed pair of ports. The inlet valve may comprise a plate-like member suspended on springs, e.g. three equi-spaced springs, between the pair of ports, the arrangement being such that the plate-like member can move against the spring pressure in response to pressure rise or pressure drop to close one or other of the ports. The means to induce ambient air into the combustion chamber may comprise a fan or blower.

If desired smoke generating material may be introduced into the combustion chamber or exhaust port to be heated by the combustion products and thus to simulate the smoke associated with gunfire. The arrangement may be such that the smoke generating material may be arranged to be burnt on exiting the simulator to provide a flash. The means may comprise a reservoir for the material, which may be a lubricating oil or a fuel oil, a pump connected to feed the material preferably to the exhaust port and means for spraying the material into the stream of combustion gases in the exhaust port. The pump may be operatively connected to the fuel gas admission means so that they operate together. The exhaust port may be lined with gauze at the position where the smoke generating material is introduced to improve the mixing of the material with the combustion gases.

The exhaust port may comprise a tuned exhaust pipe. The exhaust port may be arranged at an end of the combustion chamber opposite to the inlet valve.

The means for igniting the fuel gas in the combustion chamber may comprise a generally conventional automotive spark ignition apparatus, or may comprise a piezo-electric device. Preferably the electrodes of the spark plug are extended so that the spark occurs centrally in the combustion chamber.

The combustion chamber is preferably generally cylindrical with the exhaust port and the fuel gas admission means at one axial end and the inlet valve at the opposite axial end. A cylindrical extension to the combustion chamber may contain the means to induce ambient air into the combustion chamber.

The effective size of the exhaust port may be variable e.g. by means of a disc formed with a plurality of alternative apertures. Alternatively the exhaust port may be formed in a plate removably fixed to the combustion chamber, whereby the plate can be removed and replaced by a plate with a differently sized exhaust port. In this way the pitch and volume of sound generated by the simulator can be adjusted to match the characteristics of the weapon being simulated.

BRIEF DESCRIPTION OF DRAWINGS

The invention is diagrammatically illustrated by way of example in the accompanying drawings in which:-

BEST MODE FOR CARRYING OUT THE INVENTION

Figure 1:
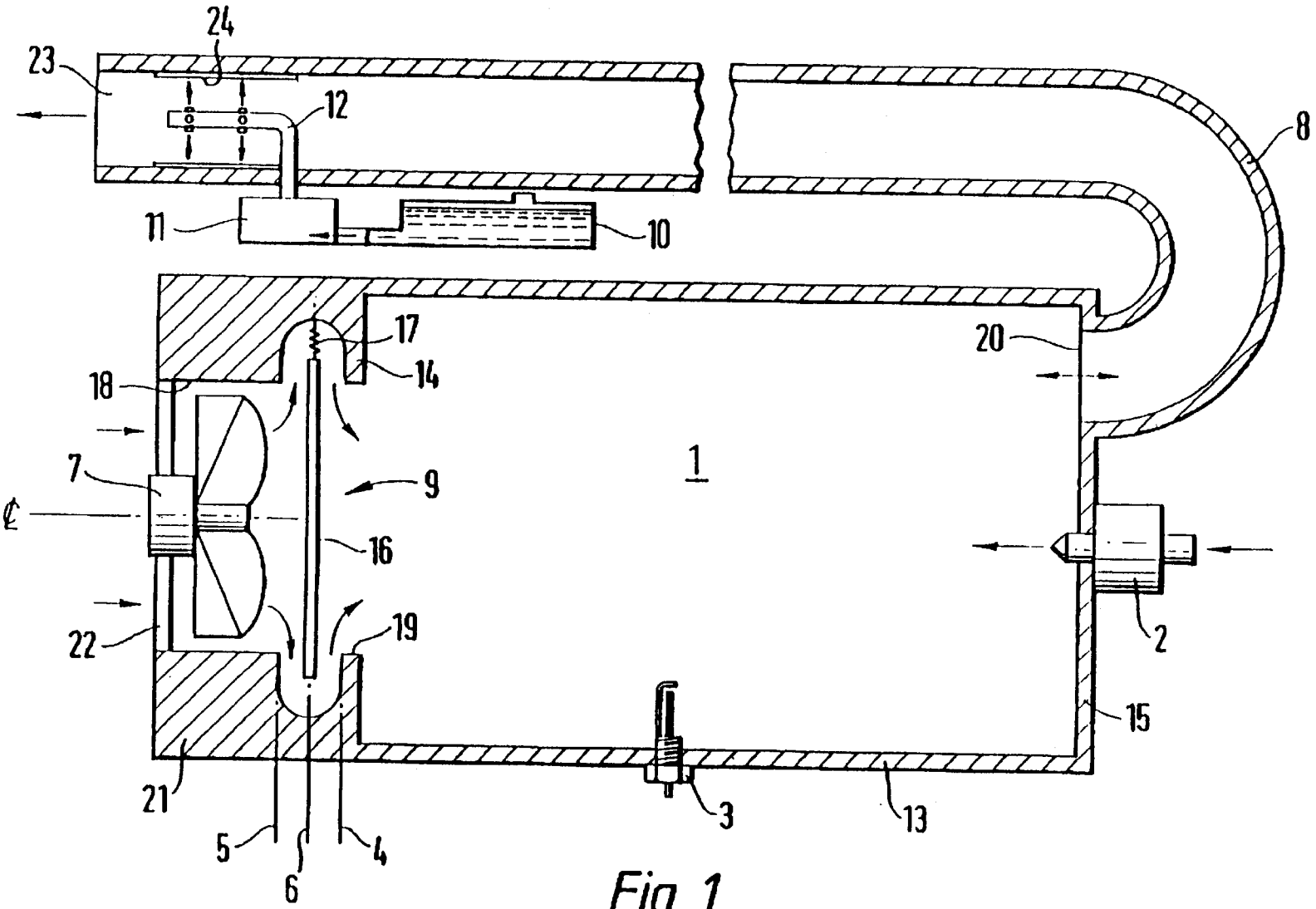
FIG. 1 is a sectional side elevation of a weapon simulator.

In the drawings a weapon simulator intended for use in battlefield weapons training e.g. to simulate gunfire or a weapon strike or an exploding mine. The simulator is similar to that described in our U.K. Patent 2250333 in many respects and comprises a generally cylindrical combustion chamber 1 defined by a cylindrical wall 13 bounded by end walls 14 and 15 respectively. The cylindrical wall 13 carries a sparking plug 3 which projects into the chamber with its electrodes extended so that ignition occurs substantially centrally. One end wall 15 carries a gas solenoid valve 2 connected to a gas supply (not shown) and which communicates with the interior of the chamber 1. The other end wall 14 is formed with an air inlet valve 9 which communicates between atmosphere and the chamber.

The inlet valve 9 comprises a light-weight disc-like plate 16 suspended on three equi-spaced springs 17, only one of which is shown in FIG. 1, such that the disc can move axially from a central rest position indicated by reference 6 in opposite directions to end positions indicated by references 5 and 4 respectively to close an opposed pair of ports 18,19 communicating between atmosphere and the combustion chamber on the occurrence of a pressure rise in the combustion chamber and on the occurrence of a depression in the combustion chamber.

The said one end wall 15 of the combustion chamber is formed with an exhaust port 20 connected to an exhaust pipe 8 of tuned length (although this is not critical) which is shown folded in the drawing in the interests of reducing the overall dimensions of the simulator.

The said other end 14 of the combustion chamber containing the inlet valve 9 is continued rearwardly by a generally cylindrical housing 21 formed with an open end 22 in which is mounted a fan or a blower 7 which is used to induce air into the combustion chamber via the inlet valve.

For the purposes of smoke and/or flash generation the simulator has an oil reservoir or tank 10 connected via an electric pump 11 to a spray bar 12 mounted in the outlet end 23 of the exhaust pipe and arranged to spray the oil generally at right angles to the pipe axis. The interior wall of the exhaust pipe is lined with a gauze material 24 at this position to assist in mixing the oil with the combustion gases. The pump 11 is operatively connected to the fuel gas solenoid 2 so that the pump and solenoid can, when desired, be arranged to operate together.

In operation of the device, a metered quantity of fuel gas, e.g. propane and/or butane, is admitted to the combustion chamber 1 through the gas valve 2. Combustion air is meanwhile induced into the combustion chamber 1 through the inlet valve 9 from the fan or blower 7, which may be arranged to operate continuously. This will have the effect of causing some part of the charge to enter the exhaust pipe 8 prior to ignition, which may be advantageous. The fuel/air mixture is then ignited by means of the spark plug 3 so that pressure within the combustion chamber rises rapidly. This rise in pressure causes the inlet valve 9 to close by movement of the disc 16 into position 5 to close the port 18. The combustion gases exit via the exhaust pipe 8 thus causing the characteristic bang of a weapon. During the rapid venting of the combustion gases to atmosphere, a depression is caused in the combustion chamber, and to prevent this depression from being filled through the inlet valve 9, the valve is arranged to close on sensing a depression by movement of the disc 16 into position 4 to close the port 19 so that the flow of gases in the exhaust is forced rapidly to reverse. We have found that increases substantially the sound production. The fan or blower 7 preferably operates continuously so that when the pressure in the chamber reaches atmospheric, the inlet valve opens into the position 6 shown in the drawing so that air is admitted to the combustion chamber to purge the chamber via the open exhaust port.

Figure 2:
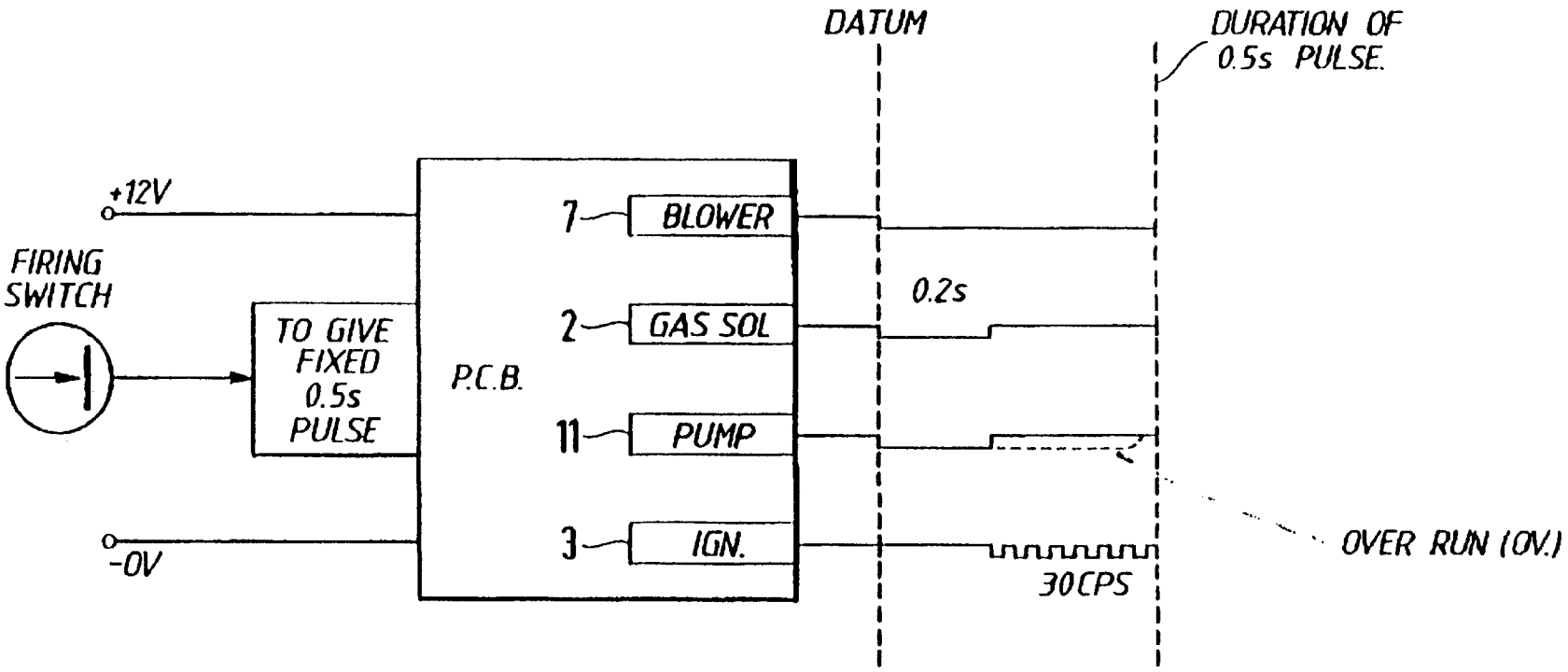
FIG. 2 is a block diagram showing the operating sequence.

The sequence of operations of the device is shown in FIG. 2 of the drawings.

In FIG. 2, it will be seen that when a firing switch is depressed, a circuit provides a pulse which causes the blower 7 to be activated (if not continuously operating) and simultaneously the solenoid valve 2 operates to admit fuel into the combustion chamber. At the same time the pump 11 may also be activated to introduce smoke generating oil, e.g. light lubricating oil or fuel oil, into the exhaust pipe. When the solenoid valve closes, a spark ignition circuit is activated to deliver a spark or preferably a series of sparks to the spark plug to explode the fuel gas/air mixture.

INDUSTRIAL APPLICABILITY

It will be appreciated that it is possible to cycle the simulator rapidly to produce a series of detonations. It will also be appreciated that if desired the smoke producing oil may also be arranged to create a flash due to its being burnt as it exits the exhaust pipe. Thus it is necessary to time the oil spraying or at least to allow the oil spraying to overrun to coincide with the movement along the pipe of the combustion gases.

The invention thus provides a simple and effective weapon simulator the operational costs of which are much reduced as compared with known simulators using pyrotechnic devices, and which, because it is self contained, can be used in battlefield simulations, e.g. to simulate mines and weapon strikes, as well as being used to simulate gun fire.

I claim:

1. A weapon simulator comprising a combustion chamber, means for admitting fuel gas to the combustion chamber, an inlet valve for admitting air to the combustion chamber, means to introduce ambient air into the combustion chamber through the valve, ignition means for igniting fuel gas in the combustion chamber to cause an explosion, and an exhaust port in the combustion chamber through which exhaust gases can exit rapidly and with audible results in response to explosive pressure rise within the combustion chamber, characterized in that the inlet valve is biased open at ambient pressure and arranged to close in response to both pressure rise and drop in the combustion chamber.

2. A weapon simulator according to claim 1, characterized in that the exhaust port is constantly open to atmosphere.

3. A weapon simulator according to claim 2, characterized in that the fuel gas admission means comprises a solenoid valve.

4. A weapon simulator according to claim 1, characterized in that the inlet valve comprises a resiliently suspended member arranged for movement in opposite directions and arranged to close an opposed pair of ports.

5. A weapon simulator according to claim 4, characterized in that the member is an axially movable plate which is biased by resilient means into a rest position in which the valve is open.

6. A gunfire simulator according to claim 1, characterized by means for admitting fuel gas into the combustion chamber in a direction towards the inlet valve.

7. A weapon simulator according to claim 1, characterized in that the exhaust port comprises a tuned pipe.

8. A weapon simulator according to claim 6, characterized by means for admitting a smoke simulating medium into the exhaust port.

9. A weapon simulator according to claim 8, characterized by means in the exhaust port for assisting in mixing the smoke simulating medium with combustion gases.

10. A weapon simulator according to claim 9, characterized in that the exhaust port is lined with gauze.

* * * * *

UNITED STATES PATENT AND TRADEMARK OFFICE

CERTIFICATE OF CORRECTION

PATENT NO. : 5,944,502

DATED : August 31, 1999

INVENTOR(S) : Clifford Denchfield

It is certified that error appears in the above-identified patent and that said Letters Patent is hereby corrected as shown below:

Title page [54], delete "WEAPON STIMULATOR" and insert --WEAPON SIMULATOR--.

Signed and Sealed this

Eighteenth Day of April, 2000

*Attest:*

Q. TODD DICKINSON

*Attesting Officer*

*Director of Patents and Trademarks*